US007579129B2

(12) United States Patent
Kamiyoshi et al.

(10) Patent No.: US 7,579,129 B2
(45) Date of Patent: Aug. 25, 2009

(54) PROCESS FOR PREPARING TONER FOR ELECTROPHOTOGRAPHY

(75) Inventors: Nobumichi Kamiyoshi, Wakayama (JP); Koji Shimokusa, Wakayama (JP); Hiroyuki Kawaji, Wakayama (JP)

(73) Assignee: Kao Corporation, Tokyo (JP)

( * ) Notice: Subject to any disclaimer, the term of this patent is extended or adjusted under 35 U.S.C. 154(b) by 583 days.

(21) Appl. No.: 11/136,370

(22) Filed: May 25, 2005

(65) Prior Publication Data

US 2005/0271965 A1 Dec. 8, 2005

(30) Foreign Application Priority Data

Jun. 4, 2004 (JP) ..... 2004-167574

(51) Int. Cl.
*G03G 9/08* (2006.01)

(52) U.S. Cl. ..... 430/111.4; 430/109.4; 430/137.14

(58) Field of Classification Search ..... 430/109.4, 430/111.4, 137.14
See application file for complete search history.

(56) References Cited

U.S. PATENT DOCUMENTS 6,413,691 B2 7/2002 Daimon et al.
6,864,029 B2 3/2005 Hamano et al.
2002/0018952 A1* 2/2002 Daimon et al. ..... 430/109.4
2002/0037468 A1* 3/2002 Matsushima et al. ..... 430/110.2
2003/0096184 A1* 5/2003 Kawaji et al. ..... 430/109.3
2004/0209182 A1* 10/2004 Kawase ..... 430/137.14
2006/0127790 A1* 6/2006 Matsumura et al. ..... 430/109.4

OTHER PUBLICATIONS

Patent Abstracts of Japan, JP 2003-167380A, Jun. 13, 2003, (corr. US 6,864,029 B2, and patent family list only).
Patent Abstracts of Japan, JP 2001-305796A, Nov. 2, 2001, (corr. US 6,413,691 B2, and patent family list only).
Patent Abstracts of Japan, JP 10-319639A, Dec. 4, 1998.
Patent Abstracts of Japan, JP 2004-051806A, Feb. 19, 2004.

* cited by examiner

*Primary Examiner*—Mark F Huff
*Assistant Examiner*—Rachel L Burney
(74) *Attorney, Agent, or Firm*—Oblon, Spivak, McClelland, Maier & Neustadt, P.C.

(57) ABSTRACT

The present invention relates to a process for preparing a toner for electrophotography comprising a crystalline polyester and a colorant, wherein the colorant is added in at least one of the neutralizing step, the emulsifying step, and the aggregating step and a process for preparing a toner for electrophotography comprising a crystalline polyester and a colorant, wherein the colorant is added in at least one of the neutralizing and emulsifying step, and the aggregating step. The toner obtained according to the process of the present invention can be suitably used, for example, in development of a latent image formed in electrophotography, electrostatic recording method, electrostatic printing method, or the like.

18 Claims, No Drawings

PROCESS FOR PREPARING TONER FOR ELECTROPHOTOGRAPHY

FIELD OF THE INVENTION

The present invention relates to a process for preparing a toner usable in the field of, for example, recording, printing and the like for copy machines, printers, facsimiles and the like, utilizing electrophotographic process.

BACKGROUND OF THE INVENTION

In recent years, toners for electrophotography fixable at a low temperature have been desired from the viewpoint of the demands of energy conservation and high-speed printing in an electrophotographic apparatus. On the other hand, toners are likely to have smaller particle sizes from the viewpoint of achieving even higher image qualities.

Processes for preparing toners include a melt-kneading and pulverization method, and a wet process such as an emulsification and aggregation method. When a toner containing a resin binder containing a crystalline polyester as a main component is prepared by the melt-kneading and pulverization method, it is difficult to control the pulverization, thereby making it impractical. On the other hand, JP-2003-167380 A and JP-2001-305796 A each discloses an invention relating to the preparation of a toner by an emulsification and aggregation method, which is a wet process. However, a resin that can be applied in this method is limited, and a strong mechanical force is required during emulsification. In addition, JP-A-Hei-10-319639 discloses a method including the step of emulsifying the components containing a hydrophobic organic solvent as an essential component, while phase-converting the components to an aqueous phase with high shearing. However, the low-temperature fixing cannot be realized by the polyester used in this method. Further, JP-2004-51806 A discloses a process for preparing a resin dispersion, but the dispersed particles contained therein have a large particle size, thereby making unsatisfactory to be used for a toner for high-image quality.

SUMMARY OF THE INVENTION

The present invention relates to:

[1] a process for preparing a toner for electrophotography containing a crystalline polyester and a colorant, including the following steps of:

(neutralizing step) neutralizing in a molten state a resin binder containing a crystalline polyester having an acidic group;

(emulsifying step) contacting the neutralized resin binder in a molten state with an aqueous medium, to prepare a dispersion containing dispersed particles containing the resin binder as a main component, the dispersed particles having an average particle size of from 0.02 to 2 μm;

(aggregating step) allowing the dispersed particles in the dispersion to aggregate to form aggregate particles containing at least the resin binder and the colorant as the constituents; and (unifying step) unifying the aggregate particles, wherein the colorant is added in at least one of the neutralizing step, the emulsifying step and the aggregating step (hereinafter referred to as "First Embodiment");

[2] a process for preparing a toner for electrophotography containing a crystalline polyester and a colorant, including the following steps of:

(neutralizing and emulsifying step) contacting in a molten state a resin binder containing a crystalline polyester having an acidic group with an aqueous medium while neutralizing the resin binder, to prepare a dispersion containing dispersed particles containing the resin binder as a main component, the dispersed particles having an average particle size of from 0.02 to 2 μm;

(aggregating step) allowing the dispersed particles in the dispersion to aggregate to form aggregate particles containing at least the resin binder and the colorant as the constituents; and (unifying step) unifying the aggregate particles, wherein the colorant is added in at least one of the neutralizing and emulsifying step, and the aggregating step (hereinafter referred to as "Second Embodiment"); and

[3] a toner for electrophotography obtained by the process as defined in the above [1] or [2], wherein the toner has a volume-average particle size of from 1 to 10 μm, and a temperature of the maximum endothermic peak determined by a differential scanning calorimeter of from 60° to 140° C.

DETAILED DESCRIPTION OF THE INVENTION

The present invention relates to a process for preparing a toner for electrophotography. The present invention relates to a toner having a small particle size which has a higher degree of freedom in the designing of resin, meeting the demands for multi-functional toners, and contains a resin dispersion easily capable of emulsifying the resin components, thereby realizing high-image qualities at a low temperature. Also, the present invention relates to a process for preparing a toner significant from the viewpoint of environmental friendliness and conservation of energy, since the toner can be prepared without an organic solvent, and exposure-preventing equipments or collection of the solvent are unnecessary.

According to the process of the present invention, there are exhibited some effects that a toner for electrophotography having a small particle size and containing a resin binder containing a crystalline polyester with a higher degree of freedom in the designing of resin can be prepared, whereby exhibiting an effect that excellent low-temperature fixing ability and storage property, and high-image quality can be simultaneously realized. In addition, there can be provided a process for preparing a toner for electrophotography which is environmental-friendly from the preparation aspect, since the toner can be prepared without an organic solvent.

These and other advantages of the present invention will be apparent from the following description.

One of the great features of the present invention resides in that by adjusting the amount of the acidic groups of the crystalline polyester molecule, and even more preferably the amount of acidic groups in the terminal of the molecule and neutralizing the resin in a molten state, the emulsification can be easily carried out even with the crystalline polyester, without requiring specialized apparatus such as a pressing apparatus or strong agitation force, thereby making it possible to prepare an excellent resin dispersion. According to the process using the dispersion, a toner for electrophotography having a small particle size which is fixable at a low temperature can be prepared using the crystalline polyester as a resin binder, whereby high-speed printing and high-image qualities can be realized.

The process for preparing a toner for electrophotography of the present invention will be explained in detail hereinbelow. Here, the neutralizing step and the emulsifying step are for First Embodiment, and the neutralizing and emulsifying step is for Second Embodiment. Other steps than those mentioned above are common between First Embodiment and Second Embodiment.

<Toner for Electrophotography and Resin Binder> The toner for electrophotography in the present invention contains a resin binder containing a crystalline polyester, and further contains at least a colorant. The amount of the crystalline polyester in the resin binder is preferably 50% by weight or more, more preferably 70% by weight or more, and even more preferably 80% by weight or more, from the viewpoint of low-temperature fixing ability.

Other resin components besides the crystalline polyester include amorphous polyesters, polyester-polyamides, vinyl resins such as styrene-acrylic resins, hybrid resins in which a plural resin components are partially chemically bonded to each other. These resin components can be used in admixture of two or more kinds. From the viewpoint of compatibility of these resins with the crystalline polyester and fixing ability of the resulting toner, the hybrid resin having an amorphous polyester component and a vinyl resin component, and the amorphous polyester are preferable. Among them, the amorphous polyester is more preferable.

<Crystalline Polyester> The crystalline polyester in the present invention has acidic groups at the terminal of the molecule. The acidic group includes a carboxyl group, a sulfonate group, a phosphonate group, a sulfinate group and the like. The carboxyl group is preferable from the viewpoint of satisfying both the emulsifiability of the resin and environmental durability of the toner prepared therefrom.

The crystalline polyester having acidic groups to be used in the present invention can be prepared by a usual polycondensation reaction. In other words, the crystalline polyester can be prepared by a dehydration polycondensation of acid components and alcohol components as raw materials, in the presence of a catalyst.

The acid component includes aliphatic dicarboxylic acids such as oxalic acid, malonic acid, maleic acid, fumaric acid, citraconic acid, itaconic acid, glutaconic acid, succinic acid, adipic acid, sebacic acid, azelaic acid, n-dodecylsuccinic acid, and n-dodecenylsuccinic acid; alicyclic dicarboxylic acids such as cyclohexanedicarboxylic acids; aromatic dicarboxylic acids such as phthalic acid, isophthalic acid, and terephthalic acid; tricarboxylic or higher polycarboxylic acids such as trimellitic acid and pyromellitic acid; anhydrides thereof, alkyl(1 to 3 carbon atoms) esters thereof; and the like. The above-mentioned acids, acid anhydrides and alkyl esters of the acids are collectively referred to herein as (carboxylic) acid compound.

It is preferable that the polyester contains an aliphatic dicarboxylic acid compound having 2 to 6 carbon atoms, such as oxalic acid, malonic acid, maleic acid, fumaric acid, succinic acid, and adipic acid, from the viewpoint of accelerating the crystallinity of the polyester. The ratio of the aliphatic dicarboxylic acid compound having 2 to 6 carbon atoms in the entire acid component is preferably from 80 to 100% by mole, and more preferably from 90 to 100% by mole, from the viewpoint of accelerating the crystallinity of the polyester. Even more preferably, fumaric acid and/or succinic acid is used in an amount of, for example, from 80 to 100% by mole, and even more preferably from 90 to 100% by mole.

Also, it is preferable that the acid component contains an aromatic dicarboxylic acid component having an aromatic ring, such as terephthalic acid, isophthalic acid, phthalic acid and naphthalenedicarboxylic acids, or an alicyclic dicarboxylic acid compound such as cyclohexanedicarboxylic acid, from the viewpoint of chargeability and durability of the toner. The ratio of these aromatic dicarboxylic acid compound and aliphatic dicarboxylic acid compound in the entire acid component is preferably from 80 to 100% by mole, and more preferably from 90 to 100% by mole, from the viewpoint of chargeability and durability of the toner. Even more preferably, terephthalic acid is used in an amount of, for example, from 80 to 100% by mole, and even more preferably from 90 to 100% by mole.

In addition, the alcohol component includes aliphatic diols such as ethylene glycol, 1,2-propanediol, 1,3-propanediol, 1,4-butanediol, 1,5-pentanediol, 1,6-hexanediol, 1,7-heptanediol, 1,8-octanediol, neopentyl glycol, and 1,4-butenediol; aromatic diols such as an alkylene oxide adduct of bisphenol A, such as polyoxypropylene(2.2)-2,2-bis(4-hydroxyphenyl)propane and polyoxyethylene(2.2)-2,2-bis(4-hydroxyphenyl)propane; trihydric or higher polyhydric alcohols such as glycerol and pentaerythritol; and the like. It is preferable that the alcohol component contains an aliphatic diol having 2 to 8 carbon atoms, from the viewpoint of accelerating the crystallinity of the polyester. Among them, $\alpha,\omega$-linear alkanediols are more preferable, and even more preferably 1,4-butanediol, 1,6-hexanediol, and 1,8-octanediol.

The ratio of the aliphatic diol having 2 to 8 carbon atoms in the entire alcohol component is preferably from 80 to 100% by mole, and more preferably from 90 to 100% by mole, from the viewpoint of accelerating the crystallinity of the polyester. Even more preferably, 1,4-butanediol, 1,6-hexanediol, 1,8-octanediol or a mixture thereof is used in an amount of, for example, from 80 to 100% by mole, and even more preferably from 90 to 100% by mole.

In other words, in order to accelerate the crystallinity of the polyester, it is preferable that the crystalline polyester is obtained by polycondensing an alcohol component containing an aliphatic diol having 2 to 8 carbon atoms in an amount of from 80 to 100% by mole, with an acid component, which is a carboxylic acid compound, and even more preferably polycondensing an alcohol component containing an aliphatic diol having 2 to 8 carbon atoms in an amount of from 90 to 100% by mole, with an acid component, which is a carboxylic acid compound.

In addition, in order to further accelerate the crystallinity of the polyester, it is preferable that the crystalline polyester is obtained by polycondensing an alcohol component containing an aliphatic diol having 2 to 8 carbon atoms in an amount of from 80 to 100% by mole, with an acid component containing an aliphatic dicarboxylic acid compound having 2 to 6 carbon atoms in an amount of from 80 to 100% by mole, and even more preferably polycondensing an alcohol component containing an aliphatic diol having 2 to 8 carbon atoms in an amount of from 90 to 100% by mole, with an acid component containing an aliphatic dicarboxylic acid compound having 2 to 6 carbon atoms in an amount of from 90 to 100% by mole.

On the other hand, it is preferable that the crystalline polyester is obtained by polycondensing an alcohol component containing an aliphatic diol having 2 to 8 carbon atoms in an amount of from 80 to 100% by mole, with an acid component containing an aromatic dicarboxylic acid compound and/or an alicyclic dicarboxylic acid compound in an amount of from 80 to 100% by mole, and even more preferably polycondensing an alcohol component containing an aliphatic diol having 2 to 8 carbon atoms in an amount of from 90 to 100% by mole, with an acid component containing an aromatic dicarboxylic acid compound and/or an alicyclic dicarboxylic acid compound in an amount of from 90 to 100% by mole, from the viewpoint of chargeability and durability of the toner.

The content of the acidic groups in the crystalline polyester can be adjusted, for example, by the compositional ratio and reactivity of the acid component and the alcohol component mentioned above, as expressed by the number of carboxyl groups at the terminal of the polyester molecule. The polycondensation reaction is terminated at the point where the acid value and the softening point reach the given values, whereby a polyester having acidic groups to be used in the present invention can be obtained. Since the content of the acidic groups at the terminal of the polyester molecule can be easily adjusted, the present invention has a feature that a crystalline polyester having excellent emulsification and dispersibility can be prepared without using an acid or alcohol component where a particular functional group is introduced. In other words, there is a great feature that the degree of freedom in the designing of the resin can be broadened.

In addition, a cross-linked structure can be introduced into the polyester by using a polycarboxylic acid such as trimellitic acid as an acid component or a polyhydric alcohol such as pentaerythritol as an alcohol component as occasion demands. In this case, the number of acidic groups at the terminal of the molecule can be 3 or more per molecule.

The amount of the acidic groups in the main chain of the polyester molecule is preferably 5% mole or less, more preferably 3% mole or less, and even more preferably 1% mole or less, based on the number of moles of the entire acid component constituting the polyester, from the viewpoint of inhibition of crystallization. In addition, the molar ratio as expressed by (acidic groups in the main chain of the molecule)/(acidic groups at the terminal of the molecule) in the polyester is, for example, 30% mole or less, preferably 20% mole or less, more preferably 10% mole or less, even more preferably 5% mole or less, and even more preferably 2% mole or less, from the same viewpoint. Here, the acidic groups in the main chain of the molecule refer to acidic groups other than the acidic groups at the terminal of the molecule; for example, a sulfonate group in the case where a dicarboxylic acid into which a sulfonate group is introduced is used as an acid component.

The amount of the acidic groups at the terminal of the molecule of the crystalline polyester to be used in the present invention is one of important factors for determining the stability of the emulsion particles and the particle size distribution and particle size of the toner. In order to stabilize the emulsion particles and obtain a toner having a small particle size with a sharp particle size distribution, the above-mentioned amount of the acidic groups at the terminal of the molecule is, for example, preferably from 0.015 to 0.9 mmol, more preferably from 0.08 to 0.85 mmol, even more preferably from 0.15 to 0.8 mmol, and even more preferably from 0.25 to 0.75 mmol, per 1 g of the crystalline polyester.

The amount of the acidic groups in the main chain of the crystalline polyester molecule and at the terminal of the molecule thereof can be calculated from the structures and the charging ratio of the raw material acid and the raw material alcohol for the crystalline polyester, the number-average molecular weight of the crystalline polyester, and the determination of the acid value. Also, the amount can be obtained by using an analytic means such as nuclear magnetic resonance spectroscopy (NMR) or X-ray photoelectron spectroscopy (XPS, ESCA) in combination with the determination of the acid value. Here, the amount of the acidic groups in the present invention include neutralized acidic groups.

The crystalline polyester has an acid value of, for example, preferably from 1 to 50 mg KOH/g, more preferably from 5 to 48 mg KOH/g, even more preferably from 10 to 45 mg KOH/g, and even more preferably from 15 to 40 mg KOH/g, per 1 g of the crystalline polyester, from the viewpoint of stabilizing the emulsion particles and obtaining a toner having a small particle size with a sharp particle size distribution.

The crystalline polyester has a melting point of preferably from 60° to 150° C., more preferably from 60° to 130° C., and even more preferably from 60° to 120° C., from the viewpoint of low-temperature fixing ability.

The crystalline polyester has a number-average molecular weight of, for example, preferably from 2000 to 100000, more preferably from 2000 to 20000, even more preferably from 2000 to 10000, and even more preferably from 2000 to 8000, from the viewpoint of emulsifiability, fixing ability and offset resistance.

The extent of the crystallinity of the polyester is expressed by crystallinity index as defined by a ratio of the softening point to the temperature of the maximum endothermic peak determined by a differential scanning calorimeter, i.e. (softening point)/(temperature of the maximum endothermic peak). Generally, when the value for the crystallinity index exceeds 1.5, the resin is amorphous, and when the value is less than 0.6, the crystallinity is low, and much of the portions are amorphous. The crystalline polyester in the present invention refers to those having the crystallinity index of from 0.6 to 1.5. The crystalline polyester has a crystallinity index of preferably from 0.8 to 1.3, more preferably from 0.9 to 1.1, and even more preferably from 0.98 to 1.05, from the viewpoint of low-temperature fixing ability. In addition, the extent of the crystallinity can be adjusted by the kinds of the raw material monomers and a ratio thereof, preparation conditions (for example, reaction temperature, reaction time, cooling rate), and the like.

<Colorant> The colorant usable in the toner for electrophotography in the present invention is not particularly limited, and includes known colorants, which can be properly selected according to its purposes. Specifically, the colorant includes various pigments such as carbon blacks, Chrome Yellow, Hansa Yellow, Benzidine Yellow, Threne Yellow, Quinoline Yellow, Permanent Orange GTR, Pyrazolone Orange, Vulcan Orange, Watchung Red, Permanent Red, Brilliant Carmine 3B, Brilliant Carmine 6B, DuPont Oil Red, Pyrazolone Red, Lithol Red, Rhodamine B Lake, Lake Red C, red iron oxide, Aniline Blue, ultramarine blue, Calco Oil Blue, Methylene Blue Chloride, Phthalocyanine Blue, Phthalocyanine Green, and Malachite Green Oxalate; and various dyes such as Acridine dyes, Xanthene dyes, azo dyes, benzoquinone dyes, Azine dyes, anthraquinone dyes, indigo dyes, thioindigo dyes, Phthalocyanine dyes, Aniline Black dyes, polymethine dyes, triphenylmethane dyes, diphenylmethane dyes, thiazine dyes, thiazole dyes, and xanthene dyes, and these pigments and dyes can be used alone or in admixture of two or more kinds.

As the method for dispersing these colorants, any methods, for example, general dispersion methods using a rotary shearing homogenizer, a ball-mill, sand-mill or DYNO MILL using media such as balls or beads can be employed without particular limitation.

<Preparation Process> After a resin binder is heated to give a molten state, a neutralizing agent is added to the molten resin binder to neutralize the resin binder containing a crystalline polyester having acidic groups. By contacting the neutralized resin binder with an aqueous medium while maintaining its molten state, an O/W type dispersion of dispersed particles containing the resin binder can be obtained as a main component, the dispersed particles having an average particle size of from 0.02 to 2 μm. Since the crystalline polyester having a high degree of crystallization is hardly soluble in an organic solvent, a usual phase-inverted emulsion method from an organic solvent phase to an aqueous phase cannot be used for actual use. In the present invention, since the crystalline polyester is neutralized in a molten state by adjusting the amount of acidic groups in the crystalline polyester molecule, especially the amount of acidic groups at the terminal of the molecular chain, the emulsification can be easily carried out even with the crystalline polyester, without requiring specialized equipment such as a pressing apparatus, or strong agitation force.

Subsequently, the resulting dispersion of the resin binder is, for example, mixed with a dispersion of a colorant or the like, and the mixture is allowed to, for example, grow into aggregated particles of which constituents are at least the resin binder and the colorant. The addition of the colorant is not limited to the aggregating step, and the addition can be carried out in at least one step of the neutralizing step, the emulsification step, and the aggregating step. Next, the aggregated particles are heated to unify. Thereafter, the unified particles are separated from the aqueous medium, washed and dried, to give toner particles for electrophotography.

Each of the preparation steps will be described more specifically hereinbelow.

<Neutralizing Step> After the resin binder used is heated to give a molten state to lower its viscosity, a neutralizing agent is added to neutralize the resin binder containing a crystalline polyester having acidic groups. By the neutralization, since the resin binder takes a structure of a salt form, the resin binder is imparted with hydrophilicity. Since the hydrophilicity of the resin can be adjusted by the amount of the acidic groups and/or the neutralization ratio of the resin used, facilitation in emulsifiability and stability of the emulsion particles during the emulsification formed can be adjusted. The temperature of the system during the neutralization is preferably not less than the melting point of the resin binder and not more than a temperature calculated from the melting point of the resin binder +(plus) 20° C., from the viewpoint of carrying out the neutralization homogeneously, and suppressing the hydrolysis during the emulsification as much as possible. Here, when the melting point of the resin binder is not observed, the temperature inside the system is preferably not less than a temperature calculated from the softening point of the resin binder −(minus) 30° C. and not more than a temperature calculated from the softening point of the resin binder +(plus) 10° C., preferably not more than the softening point.

The aqueous medium is preferably water. Also, a hydrophilic solvent which is easily miscible with water, such as an alcohol having 1 to 3 carbon atoms or acetone, can be added within the range so as not to give disadvantageous influence to the emulsification. The content of water in the aqueous medium is, for example, preferably from 50 to 100% by weight, more preferably from 80 to 100% by weight, even more preferably from 90 to 100% by weight, even more preferably from 95 to 100% by weight, and even more preferably 100% by weight of water.

The neutralizing agent usable in the present invention neutralizes acidic groups contained in the crystalline polyester resin to give a salt form of the resin, thereby increasing the hydrophilicity of the resin and exhibiting the emulsifiability for the resin, and at the same time stabilizing the dispersion of the emulsion particles in the aqueous medium.

The neutralizing agent may be an inorganic or organic basic compound. The inorganic basic compound includes, for example, alkali metal hydroxides such as sodium hydroxide, potassium hydroxide and lithium hydroxide; alkali metal salts of a week acid, such as carbonates or acetates of alkali metals; or a partially neutralized salt thereof; and ammonia. As the organic basic compound, for example, an alkylamines such as methylamine, dimethylamine, trimethylamine, ethylamine, diethylamine, and triethylamine; alkanolamines such as diethanolamine; salts of fatty acids such as sodium succinate and sodium stearate can be used. Among them, the alkylamines and the salts of the fatty acids are preferable, from the viewpoint of suppressing hydrolysis of the polyester.

The amount of the usable neutralizing agent is properly changed in accordance with the particle size of the desired emulsion particles. As for the toners having small particle sizes, the amount of the neutralizing agent is preferably from 0.2 to 2 equivalents, more preferably from 0.35 to 1.75 equivalents, and even more preferably from 0.5 to 1.5 equivalents, based on the amount of the acidic groups of the resin binder.

These neutralizing agents can be used alone, or in combination of two or more kinds. Also, the neutralizing agent may be used as it is, or the neutralizing agent may be used in the form of a solution with the aqueous medium in order to be added to the resin binder homogeneously. The concentration of the aqueous medium solution is preferably selected so that the weight of the finally added aqueous medium in the neutralizing step is the weight of the resin binder to be neutralized or lower, in order to impart the resin with the hydrophilicity necessary for the emulsification before the beginning of the emulsification. The weight of the finally added aqueous medium in the neutralizing step is more preferably 80% by weight or less, even more preferably 70% by Weight or less, even more preferably 60% by weight or less, and even more preferably 50% by weight or less, based on the weight of the resin binder.

<Emulsifying Step> The neutralized resin binder in a molten state is contacted with an aqueous medium, thereby giving a dispersion of which dispersed particles containing the resin binder as a main component have an average particle size of from 0.02 to 2 μm. It is preferable that the aqueous medium is added in a small amount rather than adding the entire amount at once, because the emulsification is likely to be more smoothly carried out to give a dispersion having excellent dispersion state.

The rate of adding the aqueous medium from the beginning of the neutralization up to the formation of the O/W type dispersion is preferably within the range of from 0.5 to 50 g/minute, more preferably from 0.5 to 10 g/minute, and even more preferably from 0.5 to 5 g/minute per 100 g of the resin binder. Here, the phrase "up to the formation of the O/W type dispersion" refers to up to a point where the O/W type emulsification is substantially terminated in the emulsifying step. The rate of adding the aqueous medium after the formation of the O/W type dispersion is not particularly limited.

Further, in the emulsifying step, it is preferable that the amount of the aqueous medium which is present up to the formation of the O/W type dispersion is from 50 to 200 parts by weight based on 100 parts by weight of the resin binder. It is more preferable that the O/W type dispersion is formed in the presence of 70 to 180 parts by weight, and even more preferably from 90 to 150 parts by weight of the aqueous medium, based on 100 parts by weight of the resin binder, from the viewpoint of homogeneity of the aggregated particles. The amount of the aqueous medium used herein includes the aqueous medium in the aqueous medium solution of the neutralizing agent added in the neutralizing step and the water generated by the neutralization, besides the aqueous medium added in the emulsifying step.

In addition, the pH in the system in the emulsifying step is preferably from 2 to 10, more preferably from 3 to 9, and even more preferably from 4 to 8, from the viewpoint of the dispersion stability of the formed dispersion, the hydrolyzability of the resin binder, and the control of the particle size.

It is preferable that the temperature inside the system in the emulsifying step is not less than the melting point of the resin binder and not more than a temperature calculated from the melting point of the resin binder +(plus) 20° C., from the viewpoint of homogeneously carrying out the neutralization and suppressing the hydrolysis during the emulsification as much as possible. Here, when the melting point of the resin binder is not observed, the temperature inside the system is preferably not less than a temperature calculated from the softening point of the resin binder −(minus) 30° C. and not more than a temperature calculated from the softening point of the resin binder +(plus) 10° C., preferably not more than the softening point. The shearing force during the stirring may be at least a force capable of homogeneously mixing the neutralized resin binder and the aqueous medium. Even in the case where a shearing force is equal to or greater than the above, an excellent dispersion is similarly obtained.

The dispersion particles which contain the resin binder as a main component have an average particle size (volume-average particle size: D50) is from 0.02 to 2 μm. The dispersion particles have an average particle size of preferably from 0.03 to 1 μm, more preferably from 0.05 to 0.6 μm, and even more preferably from 0.07 to 0.3 μm, from the viewpoint of carrying out homogeneous aggregation in the subsequent step.

In the neutralizing step or the emulsifying step, or the neutralizing and emulsifying step described below, a dispersant can be used as occasion demands for the purposes of lowering the melt index of the resin used, and improving the dispersibility of the formed dispersion. The dispersant includes, for example, water-soluble polymers such as polyvinyl alcohol, methyl cellulose, ethyl cellulose, hydroxyethyl cellulose, carboxymethyl cellulose, sodium polyacrylate, and sodium polymethacrylate; anionic surfactants such as sodium dodecylbenzenesulfonate, sodium octadecyl sulfate, sodium oleate, sodium laurate, and potassium stearate; cationic surfactants such as laurylamine acetate, stearylamine acetate, and lauryl trimethylammonium chloride; amphoteric surfactants such as lauryl dimethylamine oxide; nonionic surfactants such as polyoxyethylene alkyl ethers, polyoxyethylene alkyl phenyl ether, and polyoxyethylene alkylamine; inorganic salts such as tricalcium phosphate, aluminum hydroxide, calcium sulfate, calcium carbonate, and barium carbonate. The anionic surfactants and the nonionic surfactants are preferable from the viewpoint of emulsion stability and detergency, and the nonionic surfactants are more preferable. Among the nonionic surfactants, the polyoxyethylene alkyl ether and the polyoxyethylene alkyl phenyl ether are preferable. The amount of the dispersant in the resin binder is, for example, preferably 20% by weight or less, more preferably 15% by weight or less, and even more preferably 10% by weight or less, from the viewpoint of emulsion stability and detergency.

<Neutralizing and Emulsifying Step> After a resin binder containing a crystalline polyester having acidic groups is heated to give a molten state, the molten resin binder is contacted with an aqueous medium containing a neutralizing agent, thereby giving a dispersion of dispersed particles containing the resin binder as a main component, the dispersed particles having an average particle size of from 0.02 to 2 μm. For example, the neutralizing and emulsifying step can be carried out by a method including the step of adding a diluted aqueous medium solution of a neutralizing agent; or a method including the steps of adding a concentrated aqueous solution of the neutralizing agent (a first step), and adding a diluted aqueous solution of the neutralizing agent (a second step). In order to obtain a dispersion of dispersed particles having small particle sizes and a sharp particle size distribution, the dispersed particles containing the resin binder as a main component, it is preferable that the neutralization of the acidic groups of the resin binder necessary for emulsification is terminated before the beginning of the O/W type emulsification.

The rate of adding the aqueous medium from the beginning of the neutralization to up the formation of the O/W type dispersion is preferably within the range of from 0.5 to 50 g/minute, more preferably from 0.5 to 10 g/minute, and even more preferably from 0.5 to 5 g/minute per 100 g of the resin binder. Here, the phrase "up to the formation of the O/W type dispersion" refers to up to a point where the O/W type emulsification is substantially terminated in the neutralizing and emulsifying step. The rate of adding the aqueous medium after the formation of the O/W type dispersion is not particularly limited.

Further, in the neutralizing and emulsifying step, it is preferable that the amount of the aqueous medium which is present to the formation of the O/W type dispersion is from 50 to 200 parts by weight based on 100 parts by weight of the resin binder. It is more preferable that the O/W type dispersion is formed in the presence of 70 to 180 parts by weight, and even more preferably from 90 to 150 parts by weight of the aqueous medium, based on 100 parts by weight of the resin binder, from the viewpoint of homogeneity of the aggregated particles. The amount of the aqueous medium used herein includes the water generated by the neutralization, besides the aqueous medium added in the neutralizing and emulsifying step.

It is preferable that the temperature inside the system in the neutralizing and emulsifying step is not less than the melting point of the resin binder and not more than a temperature calculated from the melting point of the resin binder +(plus) 20° C., from the viewpoint of homogeneously carrying out the neutralization and suppressing the hydrolysis during the emulsification as much as possible. Here, when the melting point of the resin binder is not observed, the temperature inside the system is preferably not less than a temperature calculated from the softening point of the resin binder −(minus) 30° C. and not more than a temperature calculated from the softening point of the resin binder +10° C., and more preferably not less than the softening point. The shearing force during the stirring may be at least a force capable of homogeneously mixing the neutralized resin binder and the aqueous medium in the same manner as in the neutralizing step and the emulsifying step mentioned above. Even in the case where a shearing force equal to or greater than the above, an excellent dispersion is similarly obtained.

The dispersion particles which contain the resin binder as a main component have an average particle size (volume-average particle size: D50) is from 0.02 to 2 μm. The dispersion particles have an average particle size of preferably from 0.03 to 1 μm, more preferably from 0.05 to 0.6 μm, and even more preferably from 0.07 to 0.3 μm, from the viewpoint of carrying out homogeneous aggregation in the subsequent step.

<Aggregating Step> A colorant or other additives as occasion demands in the form of, for example, a dispersion are mixed with the dispersion of the dispersed particles containing the resin binder as a main component, obtained in the emulsifying step or the neutralizing and emulsifying step mentioned above, and the dispersed particles are allowed to grow to form aggregate particles containing at least the resin binder and the colorant as constituents. The solid content inside the system in the aggregating step is preferably from 5 to 50% by weight, more preferably from 5 to 30% by weight, and even more preferably from 5 to 20% by weight, in order to cause homogeneous aggregation.

In addition, the pH inside the system is preferably from 2 to 10, more preferably from 3 to 9, and even more preferably from 4 to 8, from the viewpoint of satisfying both dispersion stability of the liquid mixture and aggregation property of the fine particles such as the resin binder and the colorant. The temperature inside the system for the aggregating step is preferably not less than a temperature calculated from the melting point of the resin binder −(minus) 20° C. and not more than the melting point, more preferably not less than a temperature calculated from the melting point of the resin binder −10° C. and not more than the melting point, from the same viewpoint. Here, when the melting point of the resin binder is not observed, the temperature inside the system is preferably not less than a temperature calculated from the softening point of the resin binder −90° C. and not more than a temperature calculated from the softening point of the resin binder −30° C., and more preferably from not less than a temperature calculated from the softening point of the resin binder −80° C. and not more than a temperature calculated from the softening point of the resin binder −30° C.

In the aggregating step, in order to effectively carry out the aggregation, an aggregating agent can be added. As the aggregating agent, an inorganic metal salt, a divalent or higher polyvalent metal complex or the like may be used besides the surfactant. The inorganic metal salt includes, for example, metal salts such as calcium chloride, calcium nitrate, barium chloride, magnesium chloride, zinc chloride, aluminum chloride, and aluminum sulfate; and inorganic metal salt polymers such as poly(aluminum chloride), poly(aluminum hydroxide), and poly(calcium sulfide). Among them, the aluminum salts and polymers thereof are preferable. In order to obtain a sharp particle size distribution, the higher the valency of the inorganic metal salt, the more preferable. Even with the same valency, the inorganic metal salt polymer, which is polymerized, is more preferable. In addition, the metal complex is preferable from the viewpoint of controlling the charging properties.

The amount of the above-mentioned aggregating agent used is preferably 30% by weight or less, more preferably 20% by weight or less, and even more preferably 10% by weight or less, based on the weight of the resin binder, from the viewpoint of the environmental resistance of the toner.

In order to carry out the aggregation homogeneously, it is desired that the addition of the above-mentioned aggregating agent is carried out at a temperature of not more than the melting point of the resin binder, preferably not more than a temperature calculated from the melting point of the resin binder −(minus) 10° C., after adjusting the pH of the system in the aggregating step. Here, when the melting point of the resin binder is not observed, it is desired that the addition of the aggregating agent is carried out at a temperature of not more than a temperature calculated from the softening point of the resin binder −30° C., and more preferably not more than a temperature calculated from the softening point of the resin binder −40° C. In addition, the aggregating agent can be added in the form of an aqueous medium solution. Further, it is preferable that the mixture is sufficiently stirred upon the addition of the aggregating agent and after the termination of the addition.

<Unifying Step> The aggregated particles obtained in the above-mentioned aggregating step containing at least the resin binder and the colorant as constituents are heated to a temperature of not less than the melting point of the neutralized resin to unify the aggregated particles. The heating temperature during this step is preferably not less than the melting point of the resin binder and not more than a temperature calculated from the melting point of the resin binder +(plus) 20° C., more preferably not less than the melting point of the resin binder and not more than a temperature calculated from the melting point +15° C., and even more preferably not less than the melting point of the resin binder and not more than a temperature calculated from the melting point of the resin binder +10° C., from the viewpoint of controlling particle sizes, particle size distribution, and shapes of the desired toner, and fusibility of the aggregated particles. Here, when the melting point of the resin binder is not observed, the heating temperature is preferably not less than a temperature calculated from the softening point of the resin binder −(minus) 60° C. and not more than a temperature calculated from the softening point of the resin binder +10° C., more preferably not less than a temperature calculated from the softening point of the resin binder −60° C. and not more than the softening point of the resin binder, and even more preferably not less than a temperature calculated from the softening point of the resin binder −60° C. and not more than a temperature calculated from the softening point of the resin binder −10° C. In addition, it is preferable that the agitation rate is a rate at which the aggregated particles are not precipitated.

The resulting unified toner is subjected through the steps such as liquid-solid separation step such as filtration, washing step, and drying step, to give toner particles. Here, for the purpose of securing sufficient charging property and reliability as a toner, it is preferable that the washing is carried out with an acid for removing metal ions on the toner surface in the washing step.

In addition, in the drying step, any methods such as vibration type fluidizing drying method, spray-drying method, freeze-drying method, or flash jet method can be employed. The water content after drying the toner particles is adjusted to preferably 1.5% by weight or less, and more preferably 1.0% by weight or less, from the viewpoint of chargeability of the toner.

<Toner> By the above-mentioned process, a spherical toner having a small particle size and narrow particle size distribution suitable for high precision and high image quality can be obtained.

The toner has a volume-average particle size (D50) is preferably from 1 to 10 μm, more preferably from 2 to 8 μm, and even more preferably from 3 to 7 μm, from the viewpoint of high image quality and productivity. The toner has a particle size distribution such that its CV value (standard deviation of particle size distribution/volume-average particle size (D50)×100) is preferably 25 or less, more preferably 20 or less, and even more preferably 18 or less, from the same viewpoint.

In addition, the toner has a softening point of preferably from 60° to 140° C., more preferably from 60° to 130° C., and even more preferably from 60° to 120° C., from the viewpoint of low-temperature fixing ability. In addition, the toner has a temperature of the maximum endothermic peak determined by a differential scanning calorimeter of preferably from 60° to 140° C., more preferably from 60° to 130° C., and even more preferably from 60° to 120° C., from the same viewpoint.

The toner in the present invention may contain a charge control agent as occasion demands. As the charge control agent, a chromium-based azo dye, an iron-based azo dye, an aluminum-based azo dye, a metal complex of salicylic acid or the like can be used.

In addition, it is preferable that the toner in the present invention contains a releasing agent. By the addition of the releasing agent, the releasing property of the toner is improved in the fixing step, so that the releasing oil to be applied to a fixing roller in a contact heat-fixing method can be reduced or may not be used.

Specific examples of the releasing agent include low-molecular weight polyolefins such as polyethylene, polypropylene and polybutene; silicones; fatty acid amides such as oleic amide, erucic amide, recinoleic acid amide, and stearic acid amide; plant-derived waxes such as carnauba wax, rice wax, candelilla wax, haze wax, and jojoba oil; animal-derived waxes such as beeswax; mineral and petroleum waxes such as montan wax, ozokerite, sericite, paraffin wax, microcrystalline wax, Fischer-Tropsch wax; and the like. These releasing agents can be used alone or in admixture of two or more kinds.

The releasing agent has a melting point of preferably from 500 to 120° C., and more preferably the melting point of the resin binder or lower, in consideration of the influence on blocking resistance and the low-temperature fixing ability of the resin binder. The content of the releasing agent is preferably from 1 to 20 parts by weight, more preferably from 2 to 15 parts by weight, and even more preferably from 2 to 10 parts by weight, based on 100 parts by weight of the resin binder, in consideration of the effects on the low-temperature offset, the influence on the chargeability, and the spent of the toner resin to the carrier, and the like.

To the toner in the present invention, an aid such as a fluidizing aid can be added to the surface of the toner particles as an external additive. As the external additive, known fine particles, such as fine inorganic particles such as fine silica particles with a hydrophobic treatment, fine titanium oxide particles, fine alumina particles, fine cerium oxide particles, and carbon black, or fine particles of polymers such as polycarbonate, poly(methyl methacrylate) or silicon resin can be used.

The preparation process of the present invention can be applied to preparation of various toners, among which the process is suitably for a nonmagnetic monocomponent or two-component toner.

EXAMPLES

The following examples further describe and demonstrate embodiments of the present invention. The examples are given solely for the purposes of illustration and are not to be construed as limitations of the present invention.

<Determination Methods>

1. Acid Value and Hydroxyl Value of Resins (1) Acid value: determined according to JIS K0070.

(2) Hydroxyl value: determined according to JIS K0070.

2. Softening Point, Temperature of the Maximum Endothermic Peak, Melting Point, and Glass Transition Temperature of Resins and Toners (1) Softening Point The softening point refers to a temperature at which a half the amount of the sample flows out when plotting a downward movement of a plunger against temperature, as measured by using a flow tester (CAPILLARY RHEOMETER "CFT-500D," commercially available from Shimadzu Corporation), in which a 1 g sample is extruded through a nozzle having a dice pore size of 1 mm and a length of 1 mm, while heating the sample so as to raise the temperature at a rate of 6° C./min and applying a load of 1.96 MPa thereto with the plunger.

(2) Temperature of the Maximum Endothermic Peak and Melting Point

The temperature of the maximum endothermic peak is determined using a differential scanning calorimeter ("DSC 210," commercially available from Seiko Instruments, Inc.), by raising its temperature to 200° C. and then cooling the hot sample to 0° C. at a cooling rate of 10° C./min, and thereafter measuring the sample while raising the temperature at a rate of 10° C./min. In the resin containing a crystalline polyester, the temperature of the maximum endothermic peak is observed, which is considered as a melting point in the present invention.

(3) Glass Transition Temperature

The glass transition temperature is determined using a differential scanning calorimeter ("DSC 210," commercially available from Seiko Instruments, Inc.), by raising its temperature to 200° C. and then cooling the hot sample to 0° C. at a cooling rate of 10° C./min, and thereafter measuring the sample while raising the temperature at a rate of 10° C./min. When the resin binder contains an amorphous resin besides the crystalline polyester, the glass transition temperature refers to the temperature of an intersection of the extension of the baseline of equal to or lower than the temperature of the maximum endothermic peak and the tangential line showing the maximum inclination between the kickoff of the peak and the top of the peak.

3. Index of Crystallinity for Resins

The degree of the crystallinity (index of crystallinity) is calculated by using the following formula from the softening point and the temperature of the maximum endothermic peak in accordance with the methods mentioned above.

$$\text{Index of Crystallinity} = \text{Softening Point}/\text{Temperature of Maximum Endothermic Peak}$$

4. Number-Average Molecular Weight of Resins

The number-average molecular weight is obtained from the molecular weight distribution determined by the gel permeation chromatography according to the following method.

(1) Preparation of Sample Solution: A sample resin is dissolved in chloroform so as to have a concentration of 0.5 g/100 ml, and the resulting solution filtered with a fluororesin filter (commercially available from Sumitomo Electric Industries, Ltd., FP-200) having a pore size of 2 μm to remove insoluble components, to give a sample solution.

(2) Determination of Molecular Weight Distribution: As an eluant, chloroform is allowed to flow at a rate of 1 ml/min, and the column is stabilized in a thermostat at 40° C. One-hundred microliters of the sample solution is injected to the column to determine the molecular weight distribution. The molecular weight of the sample is calculated on the basis of a calibration curve previously prepared. The calibration curve of the molecular weight is one prepared by using several kinds of monodisperse polystyrenes as standard samples.

Analyzer: CO-8010 (commercially available from Tosoh Corporation)

Column: GMHLX+G3000HXL (commercially available from Tosoh Corporation)

5. Average Particle Size and Particle Size Distribution of Dispersed Particles (1) Preparation of the Dispersion: The amount 0.1 ml of a sample to be determined is added to 30 ml of a dispersion medium (commercially available from Kao Corporation, a 2% by weight aqueous solution of "EMAL E-27C" (sodium polyoxyethylene lauryl ether sulfate)), and dispersed with an ultrasonic disperser for one minute, to give a dispersion.

(2) Measuring Apparatus: laser diffraction particle size analyzer (commercially available from Shimadzu Corporation, "SALD-2000J")
Range of Particle Sizes to Be Determined: 0.03 to 700 μm
Analyzing Software: Wing-SALD-2000J (3) Determination Conditions: A cell for determination is charged with 10 ml of distilled water and the dispersion, and a volume-average particle size (D50) is obtained at a concentration of the dispersion so that its absorbance is within the range of 0.08 to 0.10.

6. Particle Size and Particle Size Distribution of Toners (1) Preparation of the Dispersion: 10 mg of a sample to be measured is added to 5 ml of a dispersion medium (a 5% by weight aqueous solution of "EMULGEN 109P" (commercially available from Kao Corporation, polyoxyethylene lauryl ether, HLB 13.6)), and dispersed with an ultrasonic disperser for one minute. Thereafter, 25 ml of an electrolytic solution ("Isotone II" (commercially available from Beckman Coulter)) is added thereto, and the mixture is further dispersed with an ultrasonic disperser for one minute, to give a dispersion.

(2) Measuring Apparatus: Coulter Multisizer II (commercially available from Beckman Coulter)
Aperture Diameter: 100 μm
Range of Particle Sizes to Be Determined: 2 to 60 μm
Analyzing Software: Coulter Multisizer AccuComp Ver. 1.19 (commercially available from Beckman Coulter)

(3) Measurement Conditions: One-hundred milliliters of an electrolyte and a dispersion are added to a beaker, and the particle sizes of 30000 particles are determined under the conditions for concentration satisfying that the determination for 30000 particles are completed in 20 seconds, to determine its volume-average particle size (D50) and particle size distribution.

7. Water Content of Toner

The water content is determined with an infrared moisture determination balance (commercially available from Kett Electric Laboratory, FD-230).

8. Fixing Ability of Toners

The image density of a blue solid image portion of the printout was determined with a densitometer "TR-927" (commercially available from GregtagMacbeth AG, color transmission). Thereafter, the printout was set on a rubbing testing machine equipped with a metal blade, and a blank sheet, the same one as the printout, was wound around the contact surface of the metal blade with the printout, and the blue solid image portion was rubbed forward and backward ten times with the metal blade to which a 1 kg load was applied. The image density after rubbing was again determined, and the rubbing residual ratio was calculated according to the following formula:

$$\text{Rubbing Residual Ratio}(\%) = \frac{\text{Image Density After Rubbing}}{\text{Image Density Before Rubbing}} \times 100$$

Synthesis Example 1 of Crystalline Polyester

A 10-liter four-neck flask equipped with a nitrogen inlet tube, a dehydration tube, a stirrer, and a thermocouple was charged with 1260 g of 1,4-butanediol, 3068 g of 1,6-hexanediol, 4826 g of fumaric acid, 18 g of dibutyltin oxide, and 4.5 g of hydroquinone. The ingredients were reacted at 160° C. for 5 hours, and heated to 200° C. to react for one hour. Thereafter, the ingredients were further reacted under a reduced pressure of 8.3 kPa, to give a resin A. The resin A had a softening point of 80.4° C., a temperature of the maximum endothermic peak (melting point) of 81.6° C., an index of crystallinity of 0.99, an acid value of 34.9 mg KOH/g, a hydroxyl value of 12.9 mg KOH/g, a number-average molecular weight of 3620, and an amount of acidic groups at the terminal of the molecular chain of 0.62 mmol/g.

Synthesis Example 2 of Crystalline Polyester

A 10-liter four-neck flask equipped with a nitrogen inlet tube, a dehydration tube, a stirrer, and a thermocouple was charged with 1418 g of 1,4-butanediol, 3452 g of 1,6-hexanediol, 5324 g of fumaric acid, 5 g of hydroquinone, and 20 g of dibutyltin oxide. The ingredients were reacted at 160° C. for 5 hours, and heated to 200° C. to react for one hour. Thereafter, the ingredients were further reacted under a reduced pressure of 8.3 kPa, to give a resin B. The resin B had a softening point of 82.0° C., a temperature of the maximum endothermic peak (melting point) of 85.5° C., an index of crystallinity of 0.96, an acid value of 24.5 mg KOH/g, a hydroxyl value of 6.2 mg KOH/g, a number-average molecular weight of 4290, and an amount of acidic groups at the terminal of the molecular chain of 0.44 mmol/g.

Synthesis Example of Amorphous Polyester

A 2-liter four-neck flask equipped with a nitrogen inlet tube, a dehydration tube, a stirrer, and a thermocouple was charged with 1050 g of polyoxypropylene(2.2)-2,2-bis(4-hydroxyphenyl)propane, 355 g of fumaric acid, 1 g of hydroquinone, and 1.4 g of dibutyltin oxide (esterification catalyst). The ingredients were reacted at 210° C. for 5 hours, and thereafter further reacted under a reduced pressure of 8.3 kPa. The reaction was terminated at a point where a given softening point was reached, to give a resin C. The resin C had a softening point of 102° C., a glass transition temperature of 56.9° C., a temperature of the maximum endothermic peak of 63.5° C., an index of crystallinity of 1.61, an acid value of 22.4 mg KOH/g, a hydroxyl value of 36 mg KOH/g, a number-average molecular weight of 2930, and an amount of acidic groups at the terminal of the molecular chain of 0.40 mmol/g.

Preparation Example 1 of Resin Dispersion

Two-hundred grams of the resin A was melted at 95° C. in a 5 L stainless steel pot, and 112 g of an aqueous disodium succinate.dihydrate solution (concentration: 30% by weight) was added dropwise thereto at a rate of 2 g/minute (g/min) while stirring with a paddle-shaped stirrer (commercially available from YAMATO SCIENTIFIC CO., LTD., "Labostirrer LR500B") at 60 r/min. Subsequently, deionized water was added dropwise at a rate of 2 g/min. At a point where about 50 g of deionized water was added dropwise, the mixture began to emulsify, and at a point where about 150 g of deionized water was finished adding, the emulsification was almost terminated. Thereafter, the deionized water was continued to be added, totaling to an amount of 1688 g. During the dropwise addition, the temperature of the system was kept at 95° C. A resin dispersion a having an average particle size of 0.51 μm was obtained. The final solid content was 11.7% by weight.

Preparation Example 2 of Resin Dispersion

Two-hundred grams of the resin B was melted at 98° C. in a 5 L stainless steel pot, and 103 g of an aqueous potassium hydroxide solution (concentration: 5% by weight) was added dropwise thereto at a rate of 4 g/min while stirring with the paddle-shaped stirrer at 200 r/min. Subsequently, deionized water was added dropwise at a rate of 4 g/min. At a point where about 50 g of deionized water was added dropwise, the mixture began to emulsify, and at a point where about 100 g of deionized water was finished adding, the emulsification was almost terminated. Thereafter, the deionized water was continued to be added, totaling to an amount of 702 g. During the dropwise addition, the temperature of the system was kept at 98° C. A resin dispersion b having an average particle size of 0.76 μm was obtained. The final solid content was 21.1% by weight.

Preparation Example 3 of Resin Dispersion

Two-hundred grams of the resin B was melted at 98° C. in a 5 L stainless steel pot, and 103 g of an aqueous potassium hydroxide solution (concentration: 5% by weight) was added dropwise thereto at a rate of 20 g/min while stirring with the paddle-shaped stirrer at 300 r/min. Subsequently, deionized water was added dropwise at a rate of 20 g/min. At a point where about 30 g of deionized water was added dropwise, the mixture began to emulsify, and at a point where about 100 g of deionized water was finished adding, the emulsification was almost terminated. Thereafter, the deionized water was continued to be added, totaling to an amount of 702 g. During the dropwise addition, the temperature of the system was kept at 98° C. A resin dispersion c having an average particle size of 1.8 μm was obtained. The final solid content was 21.2% by weight.

Preparation Example 4 of Resin Dispersion

Two-hundred grams of the resin B was melted at 98° C. in a 5 L stainless steel pot, and 103 g of an aqueous potassium hydroxide solution (concentration: 5% by weight) was added dropwise thereto at a rate of 50 g/min while stirring with the paddle-shaped stirrer at 300 r/min. Subsequently, deionized water was added dropwise at a rate of 50 g/min. At a point where about 20 g of deionized water was added dropwise, the mixture began to emulsify, and at a point where about 100 g of deionized water was finished adding, the emulsification was almost terminated. Thereafter, the deionized water was continued to be added, totaling to an amount of 702 g. During the dropwise addition, the temperature of the system was kept at 98° C. A resin dispersion d having an average particle size of 1.2 μm was obtained. The final solid content was 20.9% by weight.

Preparation Example 5 of Resin Dispersion

Two-hundred grams of the resin B and 10 g of copper phthalocyanine (commercially available from DAINICHISEIKA COLOR & CHEMICALS MFG. CO., LTD., "ECB301") were melted at 98° C. in a 5 L stainless steel pot, and 103 g of an aqueous potassium hydroxide solution (concentration: 5% by weight) was added dropwise thereto at a rate of 4 g/min while stirring with the paddle-shaped stirrer at 300 r/min. Subsequently, deionized water was added dropwise at a rate of 4 g/min. At a point where about 100 g of deionized water was finished adding, the emulsification was almost terminated. Thereafter, the deionized water was continued to be added, totaling to an amount of 702 g. During the dropwise addition, the temperature of the system was kept at 98° C. A resin dispersion e having an average particle size of 0.77 μm was obtained. The final solid content was 22.0% by weight.

Preparation Example 6 of Resin Dispersion

One-hundred and eighty grams of the resin B and 420 g of the resin C were mixed and melted at 98° C. in a 5 L stainless steel pot (softening point of the mixed resin: 90.4° C.), and 281 g of an aqueous potassium hydroxide solution (concentration: 5% by weight) was added dropwise thereto at a rate of 6 g/min while stirring with the paddle-shaped stirrer at 300 r/min. Subsequently, deionized water was added dropwise at a rate of 6 g/min. At a point where about 30 g of deionized water was added dropwise, the mixture began to emulsify, and at a point where about 300 g of deionized water was finished adding, the emulsification was almost terminated. Thereafter, the deionized water was continued to be added, totaling to an amount of 2133 g. During the dropwise addition, the temperature of the system was kept at 98° C. A resin dispersion f having an average particle size of 0.37 μm was obtained. The final solid content was 22.7% by weight.

Preparation Example 7 of Resin Dispersion

Two-hundred grams of the resin C was melted at 98° C. in a 5 L stainless steel pot, and 89.6 g of an aqueous potassium hydroxide solution (concentration: 5% by weight) was added dropwise thereto at a rate of 4 g/min while stirring with the paddle-shaped stirrer at 100 r/min. However, at a point where about 10 g of the aqueous potassium hydroxide solution was added dropwise, the viscosity of the system dramatically increased, thereby making impossible to stir, whereby a resin dispersion could not be prepared.

Preparation Example 8 of Resin Dispersion

Two-hundred grams of the resin B was melted at 98° C. in a 5 L stainless steel pot, and 800 g of deionized water was added dropwise thereto at a rate of 4 g/min while stirring with the paddle-shaped stirrer at 300 r/min. However, at a point where about 200 g of the deionized water was added dropwise, phase separation took place between the resin and water, thereby making it impossible to emulsify the mixture.

Preparation Example 1 of Toner

One-thousand grams of the above-mentioned resin dispersion a, the solid content of which was adjusted to 10.3% by weight with water, and 100 g (concentration: 5% by weight) of a cyan pigment-containing aqueous dispersion were mixed in a 2 L vessel at room temperature. Next, 10 g of an aqueous calcium chloride (concentration: 10% by weight) was added to this mixture, and the pH was adjusted to 7 with an aqueous sodium carbonate (concentration: 10% by weight). Thereafter, the mixture was stirred with a homo mixer (commercially available from TOKUSHU KIKA KOGYO CO. LTD., T.K. HOMO MIXER: 5000 r/min) at room temperature for 1 hour. The resulting mixed dispersion was heated to 80° C. and stirred at 60 r/min for 1 hour. Thereafter, the mixture was heated to 90° C. and stirred for an additional one hour. Subsequently, the mixture was subjected to suction filtration, and washed, to give a fine colored resin particle powder. The fine colored resin particle powder had a volume-average particle size (D50) of 6.0 μm, a CV value of 24.5, a temperature of the maximum endothermic peak (melting point) of 81.5° C., and a water content of 0.64% by weight.

A hydrophobic silica (commercially available from Wacker Chemicals, TS530) was externally added in an amount of 1.0 part by weight, based on 100 parts by weight of the colored resin particle powder with a Henschel mixer, to give a cyan toner.

Seven-hundred and sixty grams of a silicone-coated ferrite carrier (commercially available from Kanto Denka Kogyo Co., Ltd.) having an average particle size of 60 μm was added to 52 g of the above-mentioned toner while mixing to give a developer, and the blowoff triboelectric charge of the developer was determined to be −5° C./g. The developer was loaded on a copy machine (commercially available from Sharp Corporation, DIGITAL IMAGER AR-505) to develop unfixed solid images, and the fixing ability was evaluated with a fixing device to which a silicone oil was applied. As a result, the rubbing residual ratio of the fixed images at a fixing temperature of 100° C. became 100%, meaning that it is possible to fix the developer at 100° C.

Preparation Example 2 of Toner

Seven-hundred and thirty-seven grams of the above-mentioned resin dispersion b, the solid content of which was adjusted to 10% by weight with water, and 74 g (concentration: 5% by weight) of a cyan pigment-containing aqueous dispersion were mixed in a 2 L vessel at room temperature. Next, 24 g of an aqueous calcium chloride (concentration: 5% by weight) was added to this mixture, and the pH was adjusted to 7 with an aqueous sodium carbonate (concentration: 5% by weight). Thereafter, the mixture was stirred with the homo mixer (5000 r/min) at room temperature for 1 hour. The resulting mixed dispersion was heated to 80° C. and stirred at 100 r/min for 1 hour. Thereafter, the mixture was heated to 90° C. and stirred for an additional one hour. Subsequently, the mixture was subjected to suction filtration, and washed, to give a fine colored resin particle powder. The fine colored resin particle powder had a volume-average particle size (D50) of 5.2 μm, a temperature of the maximum endothermic peak (melting point) of 81.5° C., and a water content of 0.38% by weight. A cyan toner was obtained in the same manner as in Preparation Example 1 of Toner.

The evaluation for the toner was carried out in the same manner as in Preparation Example 1 of Toner.

Blowoff triboelectric charge: −9 μC/g

Evaluation for fixing ability by development of unfixed solid images: rubbing residual ratio of fixed images at a fixing temperature of 140° C.: 100%

Preparation Example 3 of Toner

One-thousand and nineteen grams of the above-mentioned resin dispersion c, the solid content of which was adjusted to 10% by weight with water, and 102 g (concentration: 5% by weight) of a cyan pigment-containing aqueous dispersion were mixed in a 2 L vessel at room temperature. Next, 34 g of an aqueous calcium chloride (concentration: 5% by weight) was added to this mixture, and the pH was adjusted to 7 with an aqueous sodium carbonate (concentration: 5% by weight). Thereafter, the mixture was stirred with the homo mixer (5000 r/min) at room temperature for 1 hour. The resulting mixed dispersion was heated to 80° C. and stirred at 100 r/min for 1 hour. Thereafter, the mixture was heated to 90° C. and stirred for an additional one hour. Subsequently, the mixture was subjected to suction filtration, and washed, to give a fine colored resin particle powder. The fine colored resin particle powder had a volume-average particle size (D50) of 7.3 μm, a temperature of the maximum endothermic peak (melting point) of 85.4° C., and a water content of 0.37% by weight. A cyan toner was obtained in the same manner as in Preparation Example 1 of Toner.

The evaluation for the toner was carried out in the same manner as in Preparation Example 1 of Toner.

Blowoff triboelectric charge: −9 μC/g

Evaluation for fixing ability by development of unfixed solid images: rubbing residual ratio of fixed images at a fixing temperature of 140° C.: 100%

Preparation Example 4 of Toner

One-thousand and forty grams of the above-mentioned resin dispersion d, the solid content of which was adjusted to 10% by weight with water, and 104 g (concentration: 5% by weight) of a cyan pigment-containing aqueous dispersion were mixed in a 2 L vessel at room temperature. Next, 35 g of an aqueous calcium chloride (concentration: 5% by weight) was added to this mixture, and the pH was adjusted to 7 with an aqueous sodium carbonate (concentration: 5% by weight). Thereafter, the mixture was stirred with the homo mixer (5000 r/min) at room temperature for 1 hour. The resulting mixed dispersion was heated to 80° C. and stirred at 100 r/min for 1 hour. Thereafter, the mixture was heated to 90° C. and stirred for an additional one hour. Subsequently, the mixture was subjected to suction filtration, and washed, to give a fine colored resin particle powder. The fine colored resin particle powder had a volume-average particle size (D50) of 8.9 μm, a temperature of the maximum endothermic peak (melting point) of 77.7° C., and a water content of 0.41% by weight. A cyan toner was obtained in the same manner as in Preparation Example 1 of Toner.

The evaluation for the toner was carried out in the same manner as in Preparation Example 1 of Toner.

Blowoff triboelectric charge: −7 μC/g

Evaluation for fixing ability by development of unfixed solid images: rubbing residual ratio of fixed images at a fixing temperature of 140° C.: 100%

Preparation Example 5 of Toner

Eight-hundred and fifty-seven grams of the above-mentioned resin dispersion e, the solid content of which was adjusted to 10% by weight with water were mixed in a 2 L vessel at room temperature. Next, 28 g of an aqueous calcium chloride (concentration: 5% by weight) was added to this mixture, and the pH was adjusted to 7 with an aqueous sodium carbonate (concentration: 5% by weight). Thereafter, the mixture was stirred with the homo mixer (5000 r/min) at room temperature for 1 hour. The resulting mixed dispersion was heated to 80° C. and stirred at 100 r/min for 1 hour. Thereafter, the mixture was heated to 90° C. and stirred for an additional one hour. Subsequently, the mixture was subjected to suction filtration, and washed, to give a fine colored resin particle powder. The fine colored resin particle powder had a volume-average particle size (D50) of 5.0 μm, a temperature of the maximum endothermic peak (melting point) of 82.5° C., and a water content of 0.42% by weight. A cyan toner was obtained in the same manner as in Preparation Example 1 of Toner.

The evaluation for the toner was carried out in the same manner as in Preparation Example 1 of Toner.

Blowoff triboelectric charge: −9 μC/g

Evaluation for fixing ability by development of unfixed solid images: rubbing residual ratio of fixed images at a fixing temperature of 140° C.: 100%

Preparation Example 6 of Toner

One-thousand and sixty-nine grams of the above-mentioned resin dispersion f, the solid content of which was adjusted to 10% by weight with water, and 112 g (concentration: 5% by weight) of a cyan pigment-containing aqueous dispersion were mixed in a 2 L vessel at room temperature. Next, 21 g of an aqueous calcium chloride (concentration: 5% by weight) was added to this mixture, and the pH was adjusted to 7 with an aqueous sodium carbonate (concentration: 5% by weight). Thereafter, the mixture was stirred with the homo mixer (5000 r/min) at room temperature for 1 hour. The resulting mixed dispersion was heated to 70° C. at a rate of 0.17° C./min while stirring the mixed dispersion at 100 r/min. Subsequently, the mixture was subjected to suction filtration, and washed, to give a fine colored resin particle powder. The fine colored resin particle powder had a volume-average particle size (D50) of 5.0 μm, a temperature of the maximum endothermic peak (glass transition temperature) of 30.8° C., and a water content of 0.41% by weight. A cyan toner was obtained in the same manner as in Preparation Example 1 of Toner.

The evaluation for the toner was carried out in the same manner as in Preparation Example 1 of Toner.

Blowoff triboelectric charge: −4 μC/g

Evaluation for fixing ability by development of unfixed solid images: rubbing residual ratio of fixed images at a fixing temperature of 140° C.: 100%

The toner obtained according to the process of the present invention can be suitably used, for example, in development of a latent image formed in electrophotography, electrostatic recording method, electrostatic printing method, or the like.

The present invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

What is claimed is:

1. A process for preparing a toner for electrophotography comprising a crystalline polyester and a colorant, comprising the following:

(neutralizing step) neutralizing in a molten state a resin binder comprising a crystalline polyester having an acidic group;

(emulsifying step) contacting the neutralized resin binder in a molten state with an aqueous medium, to prepare a dispersion comprising dispersed particles comprising the resin binder as a main component, the dispersed particles having an average particle size of from 0.02 to 2 μm, wherein a rate of adding the aqueous medium from the beginning of the neutralization up to the formation of an O/W dispersion is from 0.5 to 50 g/minute per 100 g of the resin binder;

(aggregating step) allowing the dispersed particles in the dispersion to aggregate to form aggregate particles comprising at least the resin binder and the colorant as the constituents; and (unifying step) unifying the aggregate particles, wherein the colorant is added in at least one of the neutralizing step, the emulsifying step and the aggregating step, and wherein the amount of the crystalline polyester in the resin binder is at least 80% by weight of the resin binder.

2. The process according to claim 1, wherein the crystalline polyester has a molar ratio of acidic groups in the main chain of the molecule to acidic groups at the terminal of the molecule is 30% by mole or less.

3. The process according to claim 1, wherein the crystalline polyester has the acidic groups at the terminal of the molecule thereof in an amount of from 0.015 to 0.9 mmol per 1 g of the crystalline polyester.

4. The process according to claim 1, wherein in the emulsifying step, the amount of the aqueous medium to be present up to the formation of an O/W dispersion is from 50 to 200 parts by weight based on 100 parts by weight of the resin binder.

5. The process according to claim 1, wherein the crystalline polyester is obtained by polycondensing an alcohol component comprising 80 to 100% by mole of an aliphatic diol having 2 to 8 carbon atoms and an acid component comprising a carboxylic acid compound.

6. A process for preparing a toner for electrophotography comprising a crystalline polyester and a colorant, comprising the following:

(neutralizing and emulsifying step) contacting in a molten state a resin binder comprising a crystalline polyester having an acidic group with an aqueous medium while neutralizing the resin binder, to prepare a dispersion comprising dispersed particles comprising the resin binder as a main component, the dispersed particles having an average particle size of from 0.02 to 2 μm, wherein a rate of adding the aqueous medium from the beginning of the neutralization up to the formation of an O/W dispersion is from 0.5 to 50 g/minute per 100 g of the resin binder;

(aggregating step) allowing the dispersed particles in the dispersion to aggregate to form aggregate particles comprising at least the resin binder and the colorant as the constituents; and (unifying step) unifying the aggregate particles, wherein the colorant is added in at least one of the neutralizing and emulsifying step, and the aggregating step, and wherein the amount of the crystalline polyester in the resin binder is at least 80% by weight of the resin binder.

7. The process according to claim 6, wherein the crystalline polyester has a molar ratio of acidic groups in the main chain of the molecule to acidic groups at the terminal of the molecule is 30% by mole or less.

8. The process according to claim 6, wherein the crystalline polyester has the acidic groups at the terminal of the molecule thereof in an amount of from 0.015 to 0.9 mmol per 1 g of the crystalline polyester.

9. The process according to claim 6, wherein in the neutralizing and emulsifying step, the amount of the aqueous medium to be present up to the formation of an O/W dispersion is from 50 to 200 parts by weight based on 100 parts by weight of the resin binder.

10. The process according to claim 6, wherein the crystalline polyester is obtained by polycondensing an alcohol component comprising 80 to 100% by mole of an aliphatic diol having 2 to 8 carbon atoms and an acid component comprising a carboxylic acid compound.

11. The process according to claim 1, wherein the toner is prepared in the absence of an organic solvent.

12. The process according to claim 1, wherein the crystalline polyester is obtained by polycondensing an alcohol component comprising 90 to 100% by mole of an aliphatic diol having 2 to 8 carbon atoms and an acid component comprising 90 to 100% by mole of an aliphatic dicarboxylic acid compound having 2 to 6 carbon atoms.

13. The process according to claim 1, wherein the crystalline polyester has a melting point from 60° to 120° C.

14. The process according to claim 1, wherein the crystalline polyester has a number-average molecular weight of from 2000 to 8000.

15. The process according to claim 6, wherein the toner is prepared in the absence of an organic solvent.

16. The process according to claim 6, wherein the crystalline polyester is obtained by polycondensing an alcohol component comprising 90 to 100% by mole of an aliphatic diol having 2 to 8 carbon atoms and an acid component comprising 90 to 100% by mole of an aliphatic dicarboxylic acid compound having 2 to 6 carbon atoms.

17. The process according to claim 6, wherein the crystalline polyester has a melting point from 60° to 120° C.

18. The process according to claim 6, wherein the crystalline polyester has a number-average molecular weight of from 2000 to 8000.

* * * * *